United States Patent [19]

Horikoshi et al.

[11] 4,444,647

[45] Apr. 24, 1984

[54] PROCESS FOR THE OIL EXTRACTION FROM OIL SAND BY USING CYCLODEXTRIN

[75] Inventors: Koki Horikoshi, Tokyo, Japan; Ichiro Shibanai, No. 6-10-6-312, Akasaka, Minato-ku, Tokyo, Japan

[73] Assignees: Rikagaku Kenkyusho; Ichiro Shibanai, both of Wako, Japan

[21] Appl. No.: 340,501

[22] Filed: Jan. 18, 1982

[30] Foreign Application Priority Data

Feb. 22, 1981 [JP] Japan ..... 56-8412

[51] Int. Cl.[3] ..... C10G 1/00

[52] U.S. Cl. ..... 208/11 LE; 208/8 LE

[58] Field of Search ..... 208/11 R, 11 LE

[56] References Cited

U.S. PATENT DOCUMENTS 4,255,249 3/1981 Shibanai et al. ..... 208/11 R

*Primary Examiner*—Delbert E. Gantz
*Assistant Examiner*—A. Pal
*Attorney, Agent, or Firm*—Bucknam and Archer

[57] ABSTRACT

Process for the oil extraction from oil sand comprising: mixing oil sand, cyclodextrin and water with one another to prepare a suspension, leaving it to stand or centrifuging it to separate into an oil, a water and a sand layers, and then collecting the oil layer.

17 Claims, 3 Drawing Figures

PROCESS FOR THE OIL EXTRACTION FROM OIL SAND BY USING CYCLODEXTRIN

BACKGROUND OF THE INVENTION

1. Field of the Invention

This invention relates to a novel process for the oil extraction from oil sand by using cyclodextrin.

2. Description of the Prior Art

Processes for the oil extraction from sand oil known in the art include a process for the oil extraction in situ comprising introducing steam at high temperature and high pressure into a layer containing oil sand, that is, a steam separation process, and a process for separating oil from open-air oil sand by using alkaline water at an elevated temperature. However, these processes have an economical disadvantage since they need a great amount of energy. Recently, a new oil-extraction process has been proposed which utilizes an inclusion capability of cyclodextrin and comprises including oil molecule contained in oil sand within a cavity of cyclodextrin molecule and then separating the inclusion compound to collect oil (see Japanese Patent Disclosure No. 133484/1980). This process is economically better than the steam separation process described above and comprises forming an inclusion compound of oil and cyclodextrin, separating the resulting, water-insoluble inclusion compound by any suitable technique such as centrifugation, and then introducing the separated inclusion compound into hot water or subjecting it to steam distillation to collect oil. Thus, the new process requires a troublesome operation and takes a relatively long time. The oil extraction yield of this process is not good (generally about 60%) due to the troublesome operation. As described above, the process using an inclusion compound mentioned above is not suitable for an industrial production in view of yield, time and cost.

The inventors of the present invention have paid attention to a special physical property of cyclodextrin, that is, the fact that cyclodextrin has surface activity and also accelerates separation between oil and sand contained in oil sand, and studied a process of oil extraction from oil sand by using cyclodextrin. The inventors have found that the oil extraction from oil sand may easily and effectively be conducted by mixing oil sand, cyclodextrin and water with one another to prepare a suspension and leaving the suspension to stand or centrifuging it to separate an oil layer. The present invention has been accomplished based on the discovery mentioned above.

SUMMARY OF THE INVENTION

One feature of the present invention is characterized by mixing oil sand, cyclodextrin and water with one another to prepare a suspension, leaving it to stand or centrifuging it to separate into an oil, a water and a sand layers, and then collecting the oil layer. Another feature of the present invention is characterized by mixing oil sand, cyclodextrin and water with one another to prepare a suspension, leaving it to stand or centrifuging it to separate into an oil, a water and a sand layers, collecting the oil layer, and reusing the water layer in the mixing step.

DETAILED DESCRIPTION OF THE INVENTION

Figure 1:
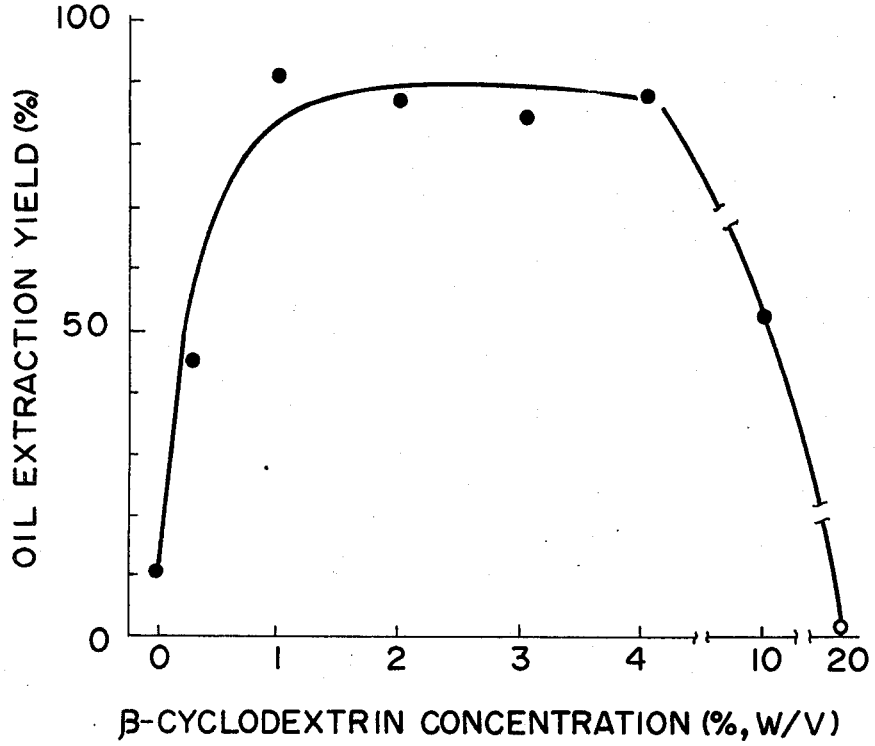
FIG. 1 is a graph showing a relationship between oil extraction yield and concentration of $\beta$-cyclodextrin in aqueous solution used in the oil extraction process.
Figure 2:
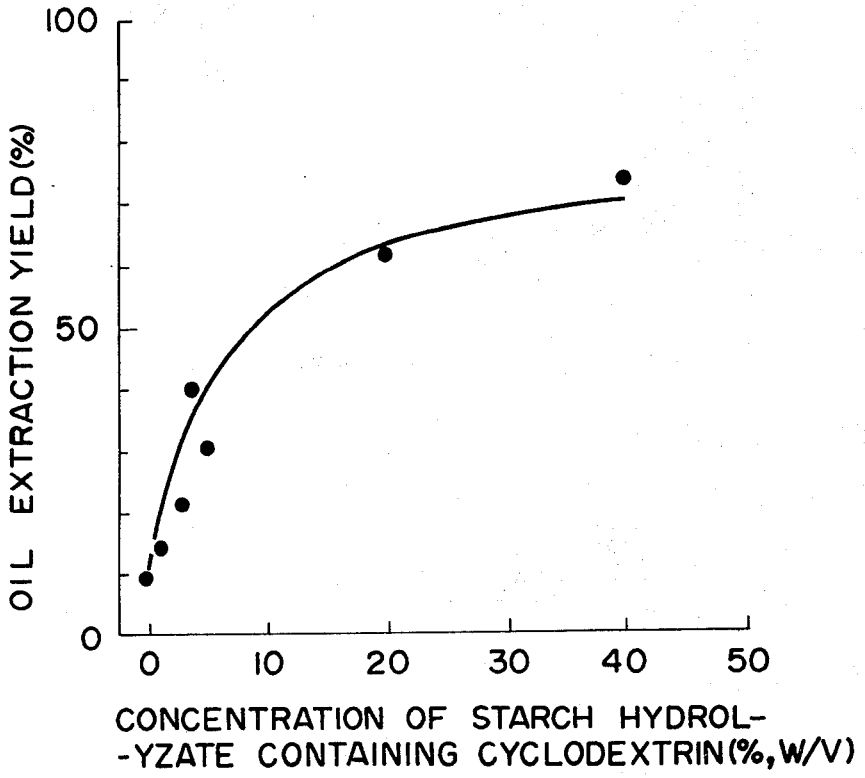
FIG. 2 is a graph showing a relationship between oil extraction yield and concentration of $\beta$-cyclodextrin-containing starch hydrolyzate in an aqueous solution used.

The terms "oil extraction yield" or "extraction yield" in the present specification mean a percent by weight of an amount of extracted oil from oil sand based on an amount of oil contained in the oil sand.

The term "oil sand" in the present specification and the claims means any type of sands, stones and rocks containing oil such as oil sand, tar sand, oil shale, tailing water sludge and the like. These oil sands generally contain oil in an amount of from several to several tens percent by weight. Tar sand is a sand layer which generally contains tar in an amount of from 6 to 20 percent by weight. Heat treatment and simple pre-purification of the tar gives an oil similar to normal crude oil. High quality oil shale is believed to contain hydrocarbon (shale oil) in an amount of more than 20 percent. The tailing water sludge is residue obtained after the oil extraction by the steam separation process described above and it normally contains oil in an amount of from about 6 to about 10 percent by weight.

Cyclodextrin used in the present invention is a special dextrin the molecule of which has a ring structure formed by a plurality of D-glucose molecules bonded each other by $\alpha$-1,4 glycosidic linkage. The interior of the cyclodextrin molecule is a cavity having a diameter of from about 6 Å to about 10 Å. It is known that various kinds of compound are included within the cavity to form an inclusion compound or a clathrate compound. There are several types of cyclodextrin which are classified by the number of D-glucose molecule constituting the cyclodextrin molecule. Among them, $\alpha$-, $\beta$- and $\gamma$-cyclodextrins the molecules of which consists of 6, 7 and 8 D-glucose molecules, respectively, are well known.

All of $\alpha$-, $\beta$- and $\gamma$-cyclodextrins described above may be used in the present invention. Cyclodextrin produced by a reaction between a starch and the cyclodextrin glycosyltransferase produced by a microorganism which belongs to the genus Bacillus such as *Bacillus macerans, Bacillus circulans* and *Bacillus megaterium,* the genus Klebsiella or the genus Micrococcus, may also be used. In addition, cyclodextrin produced by a reaction between a starch and the cyclodextrin glycosyltransferase produced by an alkalophilic bacteria ("alkalophilic bacteria" means all of cyclodextrin glycosyltransferase-producing bacteria which grow under an alkaline condition but cannot or hardly grow under an acidic or neutral condition), may be used. It is preferred to use the latter cyclodextrin which may be industrially produced with a very high advantage (see Japanese Patent Publication No. 31,223/1978 and Japanese Pat. No. 914,137).

In addition to the crystalline cyclodextrin described above, a cyclodextrin-containing filtrate obtained by filtration of a solution containing precipitated crystalline cyclodextrin, or a cyclodextrin-containing solution obtained directly by a reaction between a starch and the enzyme produced by a microorganism selected from the above group, may also be used in the present invention. This is economically advantageous as compared with the use of cyclodextrin which are commercially available or are extracted in a separated step. For example, as explained in Example 4 in detail, about one percent cyclodextrin aqueous solution is prepared by an enzymatic reaction between a starch and the enzyme produced by the alkalophilic bacteria, and then tar sand is directly added to the solution, so that the object of the present invention could be accomplished by continuous, single step without isolation of cyclodextrin.

It will be recognized that α-, β- and γ-cyclodextrins may be used singly or in combination with each other.

In the oil extraction from oil sand, the process as disclosed in the above Japanese Patent Disclosure No. 133484/1980, wherein an inclusion compound of oil and cyclodextrin is formed, separated and then followed by decomposition of the inclusion compound to separate oil included therein, give a low yield of the inclusion compound formation and further, gives a low yield of oil separation from the inclusion compound and therefore, the process is not sufficient for an industrial purpose. The inventors of the present invention paid attention to another property of cyclodextrin, that is, surface activity thereof and studied a process for direct separation of oil contained in oil sand without formation of the inclusion compound of oil and cyclodextrin.

First, one percent by weight aqueous solutions of β-cyclodextrin and various surface active agents were prepared. Two parts by weight of each solution was added to one part by weight of oil sand. The resulting mixture was stirred and left to stand. The results shown in Table 1 were obtained.

TABLE 1

| | |
|---|---|
| Water | ± |
| β-cyclodextrin (produced by Nihon Shokuhin Kako Co. (Celdex)) | + |
| Tween 20 | — |
| Tween 80 | — |
| Triton X-100 | — |
| Sodium dodecylbenzene sulfonate | — |
| Sucrose fatty acid ester | — |
| Detergent A 210 G | — |

± A small amount of oil was floated. No oil was observed on the sand layer with the naked eye.
+ A large amount of oil was floated. No oil was observed on the sand layer with the naked eye.
— No floating oil was observed. No oil was observed on the sand layer with the naked eye.

It can be seen from the table that only cyclodextrin separates and floats a large amount of oil from oil sand. Although a separating and floating mechanism of oil contained in oil sand by cyclodextrin according to the present invention is not sufficient to explain, it is believed that the mechanism is based not only on surface activity of cyclodextrin but also the other specific physical property thereof since general surface active agents do not separate oil at all.

An amount of cyclodexrin used in the process of the present invention, which may vary according to oil content in oil sand, generally is in the range of from 0.5 to 10, preferably from 1 to 6 percent by weight based on the amount of oil sand by weight. FIG. 1 shows oil extraction yield obtained by the process where a mixture of one part by weight of oil sand (mined in Alberta, Canada, 20% of oil content) and two parts by weight of an aqueous solution containing a given amount of β-cyclodextrin, was stirred for 60 minutes at 50° C., the resulting suspension was treated for 5 minutes at 100° C. and then centifuged for 10 minutes at 2,000 rpm to separate an oil layer. It is seen that under such condition where two parts by weight of an aqueous solution containing more than one percent by weight of β-cyclodextrin, that is, more than two percent by weight of β-cyclodextrin based on the weight of oil sand is used, about 90% of oil extraction yield is obtained, and that the oil extraction yield does not exceed 90% even when a concentration of β-cyclodextrin much exceeds two percent by weight. On the other hand, when a concentration of β-cyclodextrin exceeds the upper limit described above, oil molecule tends to be included within cyclodextrin molecule and precipitated, which leads to reduction of an amount of separated and floated oil and therefore, the extraction yield according to the present invention is reduced. When a concentration of β-cyclodextrin is reduced less than the lower limit described above, oil separating ability and therefore the extraction yield is lowered.

As described above, α-, β- and γ-cyclodextrins used in the present invention are not limited to a substantially pure one. A mixture of more than one of these cyclodextrins, or those containing at least one of these cyclodextrins may also be used. For example, cyclodextrin-containing starch hydrolyzate obtained as a by-product in the production of cyclodextrin by a reaction between a starch and a cyclodextrin glycosyltransferase obtained by a microorganism belonging to the genus Bacillus, or a filtrate obtained after removal of crystalline cyclodextrin by filtering the starch hydrolyzate, may also be used with an industrial advantage. Such starch hydrolyzate which is commercially available from Nihon Shokuhin Kako Co., Japan (sold under the name of Celdex CH-30 of which cyclodextrin content is 15% by weight) instead of β-cyclodextrin was used and similar test was conducted. The obtained results are given in Table 2. When a concentration of cyclodextrin-containing starch hydrolyzates was 40 percent by weight, about 80% of extraction yield was obtained.

A weight ratio of water to oil sand in the present invention is in the range of 1 to 7, preferably 1.5 to 5, most preferably 2 parts of water based on one part of oil sand. When water is used below the lower limit, it is hard to stir the mixture and the inclusion compound of oil and cyclodextrin may easily be formed. When the amount of water exceeds the upper limit, a larger system is required, which is uneconomical.

Oil sand, cyclodextrin and water may be added to a mixing vessel in any sequence and for example, cyclodextrin may be dissolved in water prior to the addition of oil sand. The above starch hydrolyzate may be used as it stands. The mixture is stirred to prepare a suspension. A temperature of the mixture and a time for stirring is not critical and may suitably be selected depending upon the amount of the mixture. The temperature may be in the range of from a room temperature to 80° C., for example, 50° C., and the time may be in the range of from 0.5 to 10 hours, for example, one hour.

After stirring, the resulting suspension is left to stand and then it is separated into three layers of oil, water and sand. This layer separation is accelerated by heating and/or centrifuging the suspension. In this case, the suspension is preferably heated to above 80° C., especially above 100° C. for from 1 to 30 minutes, for example 5 minutes.

The layer separation step may be combined with the stirring step. Thus, the mixture may be heated to above 80° C. with stirring and thereafter may be left to stand or centrifuged.

The resulting uppermost oil layer may be separated and collected by any conventional technique. The following sheet shows one example of the process of the present invention.

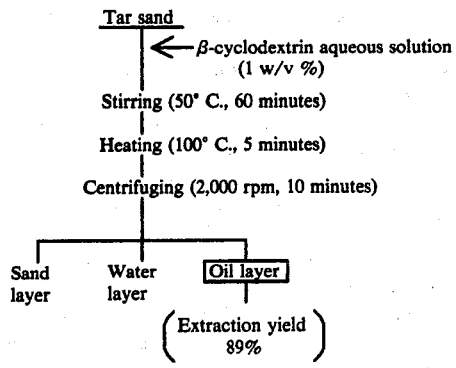

Figure 3:
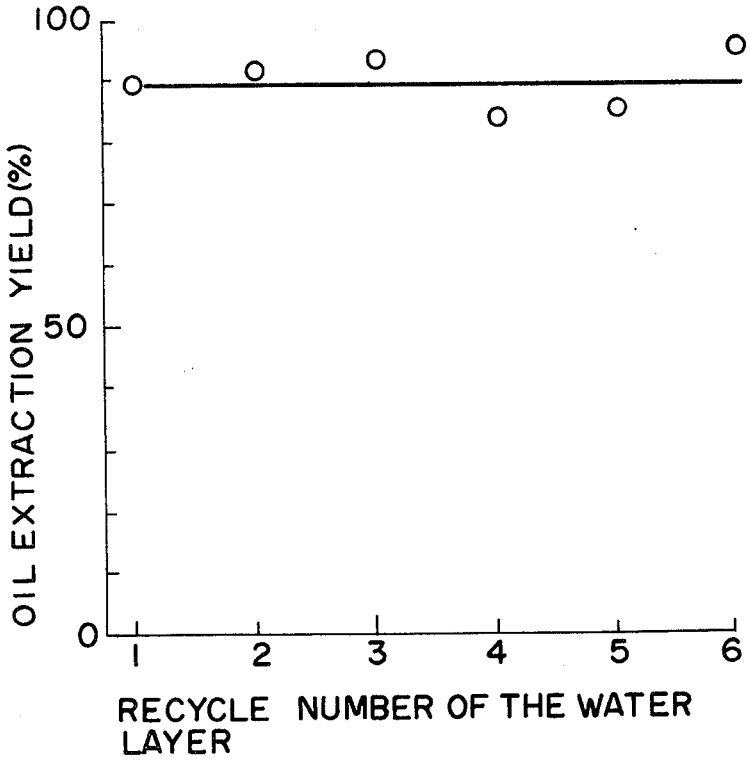
FIG. 3 is a graph showing a relationship between oil extraction yield and the number of recycling of the water layer containing $\beta$-cyclodextrin.

The resulting water layer contains dissolved cyclodextrin and therefore, it can be reused in the extraction process as it stands. In this case, the water layer may be subjected to heating and centrifuging in order to separate and remove the precipitates. If necessary, cyclodextrin and/or water may be supplied. Fresh oil sand is added to the water layer and the above process is repeated so that the present invention may be continuously conducted without substantial discharge of waste water. Oil extraction yield from oil sand according to the recycle process, as seen in FIG. 3, is very high and about 90% of oil extraction yield is maintained. One example in which the water layer is reused as stated above is illustrated by the following flow sheet.

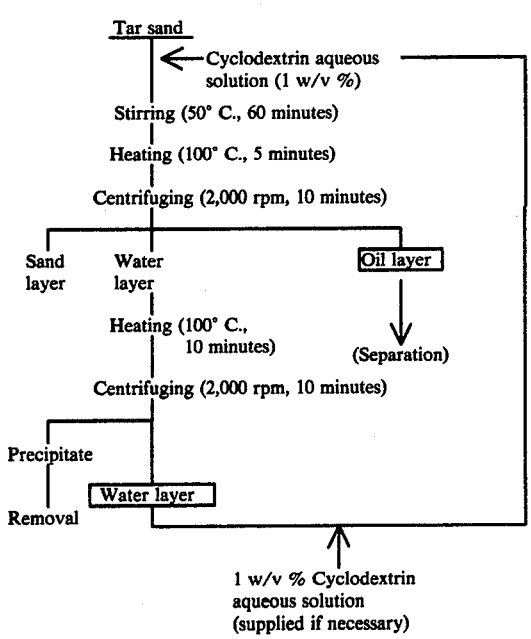

As described above, the present invention is a process for oil extraction from oil sand by using cyclodextrin, which comprises forming three layers of oil, water and sand by utilizing the property, such as surface activity, other than inclusion capability of cyclodextrin without substantially forming the inclusion compound of cyclodextrin and oil contained in oil sand, and then separating and collecting the resulting oil layer so as to collect oil as it stands.

The process of the present invention may be recycled and the water layer which contains cyclodextrin may be reused. The present invention provides a novel industrial process for the oil extraction, in which oil can be extracted continuously and at a high extraction yield. Accordingly, the present invention will extremely contribute to the development of an energy source.

The present invention will now be described in detail with reference to the following Examples.

EXAMPLE 1

20 Ml of 1 w/v % β-cyclodextrin (Celdex) aqueous solution was added to 10 g of tar sand (oil content: 20 wt.%). The mixture was stirred at 2,000 rpm for 60 minutes at 50° C. to prepare a suspension which was heated at 100° C. for 5 minutes followed by centrifuging at 2,000 rpm for 10 minutes. Three layers of oil, water and sand were formed as the upper, the intermediate and the lower layers, respectively.

The upper, oil layer was separated and collected to give 1.78 g of oil (extraction yield: 89.0%).

EXAMPLE 2

After the separation of the oil layer in Example 1, the remaining water layer was separated from the sand layer, heated at 100° C. for 10 minutes, centrifuged at 2,000 rpm for 10 minutes, and then the resulting precipitates were removed. To the residual water layer, 6.6 ml of 1 w/v % cyclodextrin aqueous solution and 10 g of tar sand were added. The procedure as described in Example 1 was repeated to form three layers of oil, water and sand. The resulting oil layer was separated to give 1.83 g of oil (extraction yield: 91.5%). After that, the residual water layer was treated as described above, β-cyclodextrin was supplied and then, the above procedure was repeated. The results thus obtained are given in Table 2 and FIG. 3.

TABLE 2

| Recycle number of the water layer | Oil extraction yield (%) | Supply of 1 w/v % β-cyclodextrin (ml) |
|---|---|---|
| 3 | 93.5 | 7.0 |
| 4 | 82.5 | 7.2 |
| 5 | 85.0 | 7.2 |
| 6 | 95.0 | 7.4 |

EXAMPLE 3

The procedure of Example 1 was repeated except that 10 g of cyclodextrin-containing starch hydrolyzate (solid content: 40 w/v %, Celdex CH-30, cyclodextrin content based on the total solid: 15 wt.%) and 10 ml of water were used instead of β-cyclodextrin aqueous solution as in Example 1. 1.5 G of oil was obtained (extraction yield: 75%).

EXAMPLE 4

0.1 G of crude enzyme produced by Bacillus No. 17-1 (ATCC 31007) was added to one liter of 1.5 w/v % starch solution (pH 10). The mixture was heated at 40° C. for 4 hours to give a cyclodextrin aqueous solution ($\alpha$: 0%, $\beta$: 80%, $\gamma$: 20%) to which 1000 g of tar sand (oil content: 20%) was added and stirred at 1,000 rpm for 10 minutes at a room temperature. Leaving to stand for 10 minutes or centrifuging at 1,000 rpm, the upper oil, the intermediate water and the lower sand layers were formed. The upper oil layer was separated to give about 190 g of oil (extraction yield: 95%).

COMPARATIVE EXAMPLE

20 Ml of 20 w/v % $\beta$-cyclodextrin (Celdex) aqueous solution was added to 10 g of tar sand (oil content: 20%). The mixture was stirred at 2,000 rpm for 60 minutes at 50° C., heated at 100° C. for 5 minutes, and then centrifuged at 2,000 rpm for 10 minutes. Three layers of oil, water and sand were not formed. Instead, the mixture was divided into a sand layer and a suspension layer. Oil was precipitated in the sand layer as an inclusion compound of cyclodextrin and oil but could not be separated as the upper oil layer (extraction yield: 0%). The resulting inclusion compound of cyclodextrin and oil was centrifuged to collect and followed by steam distillation. Only about 1.12 g of oil was obtained (extraction yield: 56%).

What we claim is:

1. A process for the oil extraction from oil sand comprising: mixing oil sand, cyclodextrin and water with one another to prepare a suspension, leaving the suspension to stand or centrifuging it to separate into an oil, a water and a sand layer, then collecting the oil layer and wherein the cyclodextrin is used in an amount of from 0.5 to 10% by weight based on oil sand.

2. The process of claim 1 wherein a weight ratio of water to oil sand is 1 to 7:1.

3. The process of claim 1 wherein the layer separation is carried out at a temperature between 80° and 100° C. for 1–30 minutes.

4. The process of claim 1 wherein the cyclodextrin is selected from the group consisting of $\alpha$-, $\beta$- and $\gamma$-cyclodextrins.

5. The process of claim 1 wherein the cyclodextrin is a product obtained by a reaction between a starch and a cyclodextrin glycosyltransferase produced by a alkalophilic bacteria.

6. The process according to claim 1 wherein the mixing is carried out at a temperature between room temperature and 80° C. for 0.5–10 hours.

7. The process according to claim 1 wherein the amount of cyclodextrin to oil sand is 1–6% by weight.

8. A process for the oil extraction from oil sand comprising: mixing oil sand, cyclodextrin and water with one another to prepare a suspension, leaving the suspension to stand or centrifuging it to separate into an oil, a water and a sand layer, collecting the oil layer, reusing the water layer in the mixing step, and wherein the cyclodextrin is used in an amount of from 0.5 to 10% by weight based on oil sand.

9. The process of claim 8 wherein a weight ratio of water to oil sand is 1 to 7:1.

10. The process of claim 8 wherein the layer separation is conducted under a heating condition.

11. The process of claim 8 wherein the water layer is heated to above 80° C. to remove precipitated solid therefrom prior to reusing.

12. The process of claim 8 wherein the cyclodextrin is selected from the group consisting of $\alpha$-, $\beta$- and $\gamma$-cyclodextrins.

13. The process of claim 8 wherein the cyclodextrin is a product obtained by a reaction between a starch and a cyclodextrin glycosyltransferase produced by a alkalophilic bacteria.

14. The process according to claim 8 wherein the mixing is carried out at a temperature between room temperature and 80° C. for 0.5–10 hours.

15. The process according to claim 8 wherein the amount of cyclodextrin to oil sand is 1–6%.

16. The process according to claim 9 wherein the weight ratio of water to oil sand is 2 parts of water to one part of oil sand.

17. The process according to claim 2 wherein the weight ratio of water to oil sand is 2 parts of the former to one part of the latter.

* * * * *

UNITED STATES PATENT AND TRADEMARK OFFICE

CERTIFICATE OF CORRECTION

PATENT NO. : 4,444,647

DATED : April 24, 1984

INVENTOR(S) : Koki Horikoshi, et al.

It is certified that error appears in the above-identified patent and that said Letters Patent are hereby corrected as shown below:

Title page, left column:

[30] Foreign Application Priority Data

Feb. 22, 1981 [JP] Japan ..... 56-8412 should be corrected to read:

[30] Foreign Application Priority Data

Jan. 22, 1981 [JP] Japan ..... 56-8412.

Signed and Sealed this

*Eighteenth* Day of *September 1984*

[SEAL]

*Attest:*

GERALD J. MOSSINGHOFF

*Attesting Officer*

*Commissioner of Patents and Trademarks*